US008234809B2

(12) United States Patent
Daniel

(10) Patent No.: US 8,234,809 B2
(45) **Date of Patent: *Aug. 7, 2012**

(54) SYSTEMS AND METHODS FOR INSTALLING A HAND GUARD ON A FIREARM

(75) Inventor: Marvin C. Daniel, Pooler, GA (US)

(73) Assignee: Daniel Defense, Inc., Black Creek, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/243,265

(22) Filed: Sep. 23, 2011

(65) Prior Publication Data

US 2012/0005936 A1 Jan. 12, 2012

Related U.S. Application Data

(62) Division of application No. 12/234,937, filed on Sep. 22, 2008, now Pat. No. 8,046,949.

(60) Provisional application No. 60/973,852, filed on Sep. 20, 2007.

(51) Int. Cl.
*F41A 21/00* (2006.01)

(52) U.S. Cl. ..... 42/75.03; 42/75.1; 42/71.01

(58) Field of Classification Search ..... 42/75.03, 42/75.1, 71.01

See application file for complete search history.

(56) References Cited

U.S. PATENT DOCUMENTS

| | | | | |
|---|---|---|---|---|
| 3,090,150 | A | 5/1963 | Stoner | |
| 4,213,263 | A | 7/1980 | Brouthers | |
| 4,536,982 | A | 8/1985 | Bredbury et al. | |
| 4,571,870 | A | 2/1986 | Heiderman et al. | |
| 4,756,111 | A | 7/1988 | Lapier | |
| 5,010,676 | A | 4/1991 | Kennedy | |
| 5,020,260 | A | 6/1991 | Houghton | |
| 5,198,600 | A | 3/1993 | E'Nama | |
| 5,343,650 | A | 9/1994 | Swan | |
| 5,433,028 | A | 7/1995 | Novak | |
| 5,590,484 | A | 1/1997 | Mooney et al. | |
| 5,826,363 | A * | 10/1998 | Olson | 42/75.01 |
| 6,023,874 | A | 2/2000 | Veit | |
| 6,293,040 | B1 | 9/2001 | Luth | |
| 6,490,822 | B1 | 12/2002 | Swan | |
| 6,499,245 | B1 * | 12/2002 | Swan | 42/71.01 |
| 6,508,027 | B1 | 1/2003 | Kim | |

(Continued)

OTHER PUBLICATIONS

International Preliminary Report on Patentability for PCT/US08/077215 mailed Feb. 23, 2010.

*Primary Examiner* — Michael Carone
*Assistant Examiner* — Samir Abdosh
(74) *Attorney, Agent, or Firm* — Sutherland Asbill & Brennan LLP

(57) ABSTRACT

Embodiments of the invention can include systems and methods for installing a hand guard on a firearm. In embodiments, a method of installing a hand guard on a firearm can be provided. The firearm includes a barrel, a barrel nut, and a delta ring. The delta ring is retracted away from the barrel nut. A number of hand guard members are positioned about the barrel. An annular groove associated with each hand guard member is mated with a portion of a flange of the barrel nut. The flange is secured within the annular groove of at least one hand guard member. The delta ring is advanced over a portion of some or all the hand guard members.

17 Claims, 3 Drawing Sheets

U.S. PATENT DOCUMENTS

| | | | | |
|---|---|---|---|---|
| 6,671,990 | B1 * | 1/2004 | Booth | 42/75.01 |
| 6,694,660 | B1 * | 2/2004 | Davies | 42/75.01 |
| 6,725,594 | B2 | 4/2004 | Hines | |
| 6,779,288 | B1 | 8/2004 | Kim | |
| 6,792,711 | B2 | 9/2004 | Battaglia | |
| 6,854,206 | B2 * | 2/2005 | Oz | 42/124 |
| 6,895,708 | B2 | 5/2005 | Kim et al. | |
| 6,931,775 | B2 | 8/2005 | Burnett | |
| 6,959,509 | B2 | 11/2005 | Vais | |
| 6,971,202 | B2 | 12/2005 | Bender | |
| 7,059,076 | B2 | 6/2006 | Stoner et al. | |
| 7,131,228 | B2 | 11/2006 | Hochstrate et al. | |
| RE39,465 | E | 1/2007 | Swan | |
| 7,216,451 | B1 | 5/2007 | Troy | |
| 7,363,741 | B2 | 4/2008 | DeSomma et al. | |
| 7,506,468 | B2 | 3/2009 | Farrell et al. | |
| 7,716,865 | B2 * | 5/2010 | Daniel et al. | 42/75.02 |
| 8,046,949 | B1 * | 11/2011 | Daniel | 42/75.02 |
| 8,051,595 | B2 * | 11/2011 | Hochstrate et al. | 42/75.01 |
| 2003/0074822 | A1 * | 4/2003 | Faifer | 42/71.01 |
| 2007/0017139 | A1 * | 1/2007 | Larue | 42/75.1 |
| 2007/0261285 | A1 * | 11/2007 | Troy | 42/75.03 |
| 2009/0013579 | A1 * | 1/2009 | Fluhr | 42/71.01 |
| 2010/0126054 | A1 * | 5/2010 | Daniel et al. | 42/71.01 |
| 2010/0175293 | A1 * | 7/2010 | Hines | 42/71.01 |
| 2010/0269392 | A1 * | 10/2010 | Swan | 42/71.01 |
| 2010/0319231 | A1 * | 12/2010 | Stone et al. | 42/71.01 |
| 2011/0061281 | A1 * | 3/2011 | Kapusta et al. | 42/71.01 |
| 2011/0192066 | A1 * | 8/2011 | Kimmel et al. | 42/71.01 |

* cited by examiner

SYSTEMS AND METHODS FOR INSTALLING A HAND GUARD ON A FIREARM

CROSS-REFERENCE TO RELATED APPLICATION

The present application is a divisional of and claims the benefit of U.S. patent application Ser. No. 12/234,937, filed Sep. 22, 2008, issued as U.S. Pat. No. 8,046,949, which claims the benefit of U.S. Provisional Patent Application No. 60/973,852, filed Sep. 20, 2007, which are both incorporated by reference in their entirety.

TECHNICAL FIELD

The present disclosure generally relates to a hand guard for a firearm, and more particularly relates to systems and methods for installing a hand guard on a firearm.

BACKGROUND OF THE INVENTION

Firearms such as rifles normally include a relatively elongated barrel that is gripped by a user during firearm operation. Because the barrel may become hot with repeated firing, the firearm is normally equipped with a hand guard that is positioned about an exterior surface of the barrel. During operation, the user may grip the hand guard instead of the barrel to protect his hand from the heat.

The hand guard may be secured to the firearm using at least some existing components of the firearm. For example, the firearm usually includes a front sight base, which is used to sight the firearm, and a barrel nut, which is used to attach the barrel to the firearm. These components may also be employed to associate the hand guard with the firearm. More specifically, the hand guard may be positioned between the front sight base and the barrel nut, a forward end of the hand guard may fit into a hand guard cap adjacent the front sight base, and a rearward end of the hand guard may be positioned between the barrel nut and a delta ring. Such a configuration is described in U.S. Pat. No. 3,090,150 entitled "Hand Guard Construction".

In some cases, the hand guard provided with the firearm may be replaced with a replacement hand guard. The replacement hand guard may have a range of configurations. For example, the replacement hand guard may have a rail system for mounting one or more accessories to the firearm, such as a scope, a grenade launcher, or a laser, among others. The replacement hand guard may also be free-floating, meaning spaced apart from the barrel in a radial direction to form an air gap about the barrel. The air gap may dissipate heat so that the user may grip the hand guard without being burned. The air gap also may provide a relief area for absorbing displacement caused by the grip of the user or the weight of an accessory, which may affect the direction of the projectile. The air gap also may reduce the impact of adding or removing accessories on the harmonics of the barrel, reducing the need to re-zero the firearm.

To install a replacement hand guard, the hand guard initially provided with the firearm may be removed, which typically requires retracting the delta ring, removing the rearward end of the hand guard from the barrel nut, removing the forward end of the hand guard from the hand guard cap, and separating the hand guard from the firearm. The replacement hand guard then may be installed on the firearm.

Some replacement hand guards may attach to both the hand guard cap and the barrel nut. However, such replacement hand guard members are not free-floating. Thus, when the user grasps the hand guard, or adds or removes accessories, the aim of the firearm may be disturbed.

Some replacement guards also may be relatively cumbersome to install. For example, it may be necessary to remove one or more of the front sight base, the hand guard cap, the barrel nut, and the delta ring. However, the user may not have the skills, tools, or authority to remove or adjust these components. For example, military and police personnel are often not permitted to remove these components of the firearm.

Some replacement hand guards are formed in a single piece that encircles the barrel of the firearm. Because such replacement hand guards cannot be slid over the front sight base and the hand guard cap, installing such a replacement hand guard requires either removing the front sight base and the hand guard cap or separating the barrel from the upper receiver of the firearm, which ultimately requires removing the front sight base, the hand guard cap, and the barrel nut.

Some replacement hand guards are installed using an attachment mechanism that secures the hand guard to the barrel nut. Typically, the attachment mechanism is a bulky structure that clamps the hand guard about the circumferential surface of the barrel nut. Such an attachment mechanism may be too large to fit between the barrel nut and the delta ring, and therefore the delta ring may be removed from the firearm to install the replacement hand guard in such cases.

Still other replacement hand guards may be securely attached to the firearm without removing components of the firearm. For example, some known replacement hand guards include an extension member that attaches to the upper receiver. These replacement hand guards change the layout of the weapon. For example, the height of the upper receiver may be increased, which may raise the line of sight of the user or affect the compatibility of the firearm with standard accessories. Also, these and other replacement hand guards may be relatively heavy. Therefore, a need exists for systems and methods for installing a hand guard on a firearm.

SUMMARY OF THE INVENTION

Embodiments of the invention can include systems and methods for installing a hand guard on a firearm. In certain embodiments, a method of installing a hand guard on a firearm may be provided. The firearm may include a barrel, a barrel nut, and a delta ring. The method may include retracting the delta ring away from the barrel nut. One or more hand guard members may be positioned about the barrel. An annular groove associated with each hand guard member may be mated with at least a portion of a flange of the barrel nut. The flange may be secured within the annular groove of at least one hand guard member. The delta ring may be advanced over at least a portion of some or all of the hand guard members.

In another embodiment, a hand guard assembly may be provided. The hand guard assembly may be installed on a firearm. The firearm may include a barrel nut. The hand guard assembly may include a number of hand guard members, a coupling mechanism, and a securing mechanism. The coupling mechanism may be configured to couple at least some of the hand guard members together. The securing mechanism may be configured to secure at least one of the hand guard members to the barrel nut. The securing mechanism may apply a clamping force in a direction generally parallel to a longitudinal axis of the firearm.

In embodiments, a method may be used to install a hand guard on a firearm. The firearm may have a barrel nut and a delta ring. In the method, a delta ring may be retracted away from a barrel nut. A first hand guard member may be positioned about a portion of the barrel nut, and a second hand guard member may be positioned about a portion of the barrel nut. The first hand guard member may be coupled to the second hand guard member. The delta ring may be advanced over a portion of one or both of the hand guard members, and at least one of the hand guard members may be secured against the barrel nut.

Other features and advantages of embodiments of systems and methods for installing a hand guard on a firearm will be apparent or will become apparent to one with skill in the art upon examination of the following figures and detailed description. All other features and advantages, as well as other system and method embodiments, are intended to be included within the description and are intended to be within the scope of the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION OF EMBODIMENTS

Described below are embodiments of systems and methods for installing a hand guard on a firearm. In embodiments, such systems and methods may comprise a hand guard assembly. The hand guard assembly may be installed on a firearm without removing certain components of the firearm or disassembling the firearm. Thus, the hand guard assembly may be installed by a user having relatively little skill and relatively few tools. For example, the hand guard assembly may be secured to existing components of the firearm, such as a barrel nut of the firearm, without removing components of the firearm, such as a barrel nut, delta ring, or front sight base of the firearm.

As used herein, the term "barrel" refers to a component of the firearm that extends longitudinally from the upper receiver. The barrel permits projecting the projectile. The term "front sight base" refers to a component of the firearm that may be positioned about the barrel near a forward end of the barrel. The front sight base permits sighting the firearm. The term "barrel nut" refers to a component positioned about the barrel near a rearward end of the barrel. The barrel nut permits attaching the barrel to the firearm. The term "delta ring" refers to a component positioned about the barrel nut. The delta ring permits attaching a hand guard to the firearm.

In embodiments, the hand guard assembly may be clamped to the barrel nut of the firearm. In some such embodiments, the hand guard assembly may include a connector and a clamping device. The connector may connect the hand guard assembly to the firearm, and the clamping device may apply a clamping force to the connector. For example, the connector may be positioned about the barrel nut, and the clamping device may clamp the connector about the barrel nut. The clamping force applied by the clamping device may be applied in a direction generally parallel to a longitudinal axis of a barrel of the firearm.

In embodiments, the hand guard assembly may be one or both of a free-floating hand guard and a rail system, although the hand guard assembly can have other configurations, shapes, and/or sizes in accordance with the invention.

Figure 1:
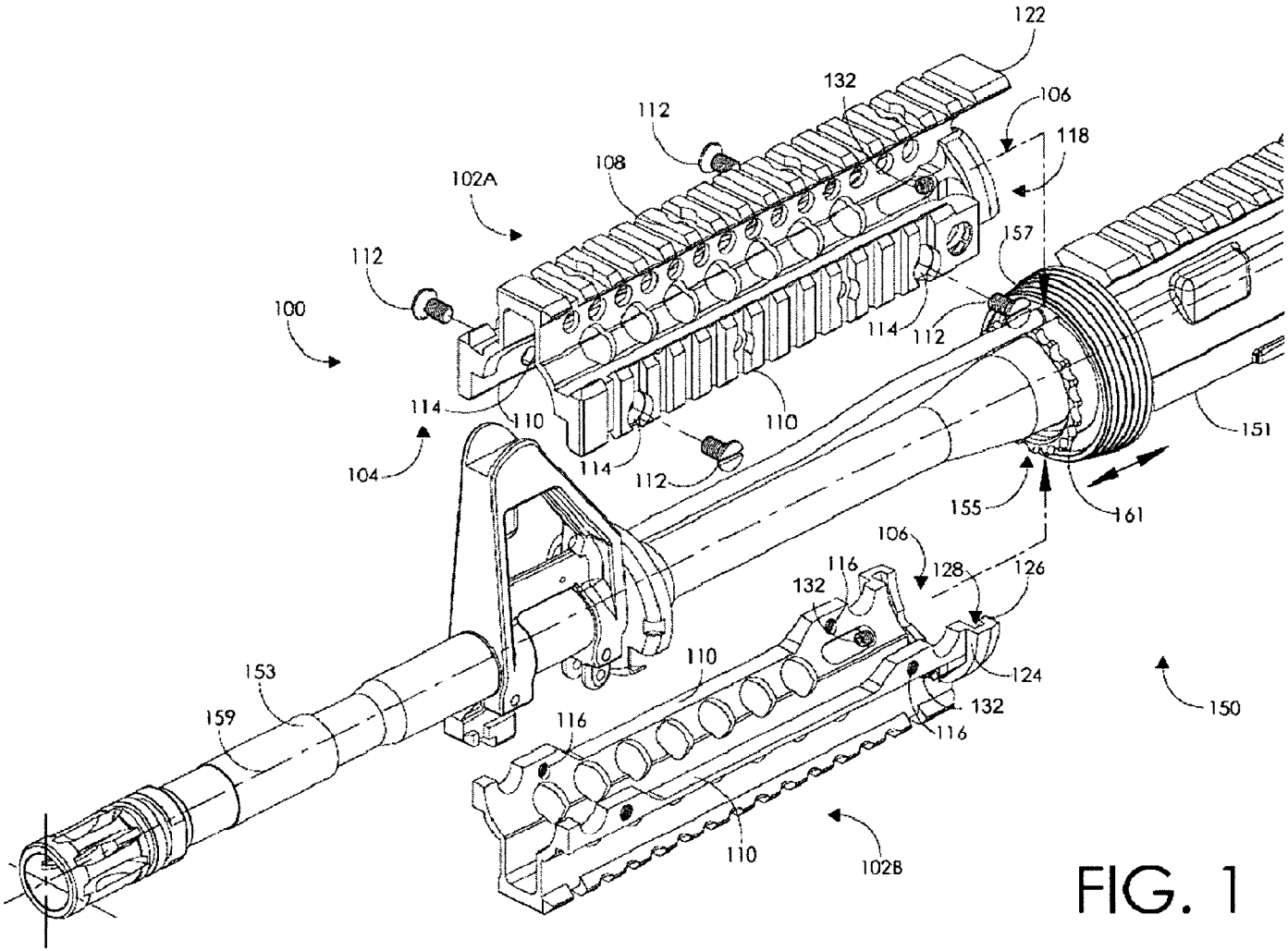
FIG. 1 is an exploded perspective view of a hand guard assembly, in accordance with an embodiment of the invention.

FIG. 1 is an exploded perspective view of an embodiment of a hand guard assembly 100 positioned adjacent to a portion of a firearm 150, in accordance with an embodiment of the invention. The firearm 150 may be a conventional firearm. For example, the firearm 150 may be an M-16 style rifle, an AR-15 style rifle, an AR-10 style rifle, or an M-4 style rifle, among others. As shown in FIG. 1, the firearm 150 generally includes an upper receiver 151, a barrel 153, a barrel nut 155, and a delta ring 157.

The upper receiver 151 generally houses internal components of the firearm 150 and is not shown in detail in FIG. 1. The barrel 153 may extend from the upper receiver 151 about a longitudinal axis 159. The barrel 153 may be secured to the upper receiver 151 using the barrel nut 155, which may be concentrically mounted about the barrel 153 adjacent to the upper receiver 151.

The barrel nut 155 may include a flange 161 having a number of scallops formed therethrough. The flange 161 may be generally transverse to the longitudinal axis 159 and may encircle the barrel 153. For example, the flange 161 may lie in a plane that is substantially perpendicular to the barrel 153. Each scallop may be sized and shaped to mate with a gas tube that runs along a length of the barrel 153. The gas tube may communicate gas from a muzzle end of the barrel 153 to the upper receiver 151. When the barrel 153 is coupled to the upper receiver 151, the gas tube may be positioned in any one of the scallops to retain the gas tube during operation of the firearm 150.

The delta ring 157 may be positioned about an exterior of the barrel nut 155. More specifically, the delta ring 157 may be concentrically mounted with reference to the barrel 153 between the barrel nut 153 and the upper receiver 151. The delta ring 157 may be movable along the longitudinal axis 159 of the barrel 153 within a selected range of motion. In embodiments, the delta ring 157 may be spring loaded. For example, the delta ring 157 may be movable between a rest position, in which the delta ring 157 extends over the flange 161 of the barrel nut 155, and a retracted position in which the delta ring is retracted from the flange 161 of the barrel nut 155. Therefore, the delta ring 157 in the rest position may be relatively closer to the muzzle end of the firearm 150 than the delta ring 157 in the retracted position.

As shown, the hand guard assembly 100 generally includes one or more hand guard members 102, a coupling mechanism 104, and a securing mechanism 106. The hand guard members 102 may be positioned about the barrel 153 of the firearm 150, and the coupling mechanism 104 may couple the hand guard members 102 together to form a hand guard. The securing mechanism 106 may secure the hand guard to the firearm 150, such as by securing one or more of the hand guard members 102 to the barrel nut 155, although other configurations are possible.

Each of the hand guard members 102 may be shaped to shield at least a portion of the barrel 153. For example, each hand guard member 102 may be shaped to extend along a portion of a length of the barrel 153, in the longitudinal direction generally coincident with the longitudinal axis 159, and to extend about at least a portion of the circumference of the barrel 153, in a radial direction substantially perpendicular to the longitudinal axis 159. When combined, the hand guard members 102 may extend around some or all of the circumference of the barrel 153 to shield some or all of the circumference of the barrel 153.

In the embodiment shown in FIG. 1, the hand guard assembly 100 may include two hand guard members 102. As shown, the hand guard members 102 may include an upper hand guard member 102A that is to be positioned above the barrel 153 and a lower hand guard member 102B that is to be positioned below the barrel 153. Each hand guard member 102 may be sized and shaped to shield about one-half of the circumference of the barrel 153, so that together the hand guard members 102 shield a substantial portion of the circumference of the barrel 153. In other embodiments, the hand guard members, when combined, may not shield a substantial portion of the circumference of the barrel 153. Further, one hand guard member may shield more or less of the barrel 153 than the other hand guard member. Also, two hand guard members are shown for exemplary purposes, although greater or fewer hand guard members may be provided.

As shown, each hand guard member 102 may be sized so that an interior surface of the hand guard member 102 is spaced apart from the barrel 153 when the hand guard member 102 is positioned adjacent to the barrel 153. More specifically, each hand guard member 102 may have relatively larger dimensions in the radial direction than a corresponding portion of the barrel 153. Such sizing may permit an air gap to form between the hand guard member 102 and the barrel 153 so that the barrel 153 may be free-floating. In other embodiments, the hand guard members 102 may not be sized to be spaced apart from the barrel 153, but may envelope or nest in close proximity with the barrel 153.

As shown, each hand guard member 102 may include a rail 108. Therefore, the hand guard assembly 100 may be a rail assembly configured for mounting one or more accessories (not shown) to the firearm 150. In other embodiments, rails 108 may be provided on less then all of the hand guard members 102. In still other embodiments, the hand guard assembly 100 may not be a rail assembly, in which case the rails 108 may be omitted from the hand guard members 102 completely.

It should be noted that directional terms are provided for the purposes of illustration and are not intended to limit the disclosure. Further, the directional terms generally describe the relative position of a component when the component is positioned on the firearm 150, and the firearm 150 is positioned in the intended orientation. For example, the term "upper" generally denotes the relative position of the upper hand guard member 102A when the firearm 150 is held in the intended orientation, while the term "lower" generally denotes the relative position of the lower hand guard member 102B when the firearm 150 is held in the intended orientation. Orienting the hand guard members 102 as indicated by such directional terms may be relevant in cases in which one or more of the hand guard members 102 includes a rail 108 for mounting accessory devices, as described above. Otherwise, the hand guard members 102 may be positioned in any orientation about the barrel 153 of the firearm 150. Further, the term "forward" generally denotes a direction facing away from the upper receiver 151 and facing toward the muzzle end of the firearm 150, while the term "rearward" generally denotes a direction facing away from the muzzle end of the firearm 150 and facing toward the upper receiver 151.

As mentioned above, the coupling mechanism 104 may couple at least some of the hand guard members 102 together to form a hand guard. For example, the coupling mechanism 104 may couple each hand guard member 102 to each adjacent hand guard member 102, such that the hand guard members 102 form a relatively continuous hand guard that encloses at least a portion of the circumference of the barrel 153. In embodiments such as the one illustrated, each hand guard member 102 may have two longitudinal edges 110, and the coupling mechanism 104 may be configured to couple each longitudinal edge 110 to an adjacent longitudinal edge 110 on an adjacent hand guard member 102. For example, each longitudinal edge 110 of the upper hand guard member 102A may be coupled to one of the longitudinal edges 110 of the lower hand guard member 102B in the illustrated embodiment.

In other embodiments, the coupling mechanism 104 may be configured to couple the hand guard members 102 together other than at the longitudinal edges 110. Additionally, the coupling mechanism 104 may not be configured to couple each hand guard member 102 to each adjacent hand guard member 102. Instead, the coupling mechanism 104 may be configured to couple some of the adjacent hand guard members 102 together but not others. In still other embodiments, the coupling mechanism 104 may be omitted completely, in which case the hand guard members 102 may not be coupled together.

The coupling mechanism 104 may include a number of fasteners 112, such as screws. For each fastener 112, one of the hand guard members 102 may have a passage 114 and one of the other hand guard members 102 may have a corresponding threaded coupling 116. When the hand guard members 102 are positioned adjacent to each other, the passages 114 and the threaded couplings 116 may align so that one of the fasteners 112 can placed through the passage 114 on the one hand guard member 102 into the threaded coupling 116 on the other hand guard member 102. The passages 114 and the threaded couplings 116 may be relatively evenly distributed about the hand guard members 102, so that the fasteners 112 may create a relatively uniform and secure connection.

In the illustrated embodiment, the passages 114 and threaded couplings 116 are positioned along the longitudinal edges 110 of the hand guard members 102, with the passages 114 being formed through the upper hand guard member 102A and the threaded couplings 116 being positioned on the lower hand guard member 102B. In other embodiments, the configuration could be reversed in whole or in part.

In the illustrated embodiment, four passages 114 and four threaded couplings 116 are provided on the upper and lower hand guard members 102, respectively. These passages 114 and threaded couplings 116 are relatively evenly distributed on a forward left side, a forward right side, a rearward left side, and a rearward right side of the longitudinal edges 110. Such relatively even distribution can facilitate creating a relatively secure and uniform connection between the two hand guard members 102. However, a range of other configurations are possible. Any number of fasteners 112 can be employed at any position along the hand guard members 102, and therefore any number and position of corresponding passages 114 and threaded couplings 116 may be formed through the hand guard members 102. Additionally, fasteners 112 other than screws can be used, in which case the passages 114 and threaded couplings 116 may be omitted or altered as appropriate. For example, the hand guard members 102 may have pressure fittings or snap fittings that are designed to mate with each other.

The coupling mechanism 104 may be configured to be releasable so that the hand guard members 102 can be uncoupled if desired. For example, in the illustrated embodiment the hand guard may be disassembled by removing the fasteners 112 from the passages 114 and the threaded couplings 116. However, the coupling mechanism 104 may not be releasable in other embodiments, or the coupling mechanism 104 may be releasable in other manners.

As mentioned above, the securing mechanism 106 may be configured to secure the hand guard assembly 100 to the firearm 150. For example, the securing mechanism 160 may secure at least one of the hand guard members 102 to the firearm 150. In the illustrated embodiment, each of the hand guard members 102 is secured to the firearm 150 using the securing mechanism 160, but in other embodiments less than all of the hand guard members 102 may be secured to the firearm 150 using the securing mechanism 106. For example, two hand guard members 102 otherwise attached to each other via a coupling mechanism 104 may be secured to the firearm 106 using a securing mechanism 106 on one of the hand guard members 102.

In embodiments, the securing mechanism 106 may include at least one connector 118 and at least one clamping device 120. The connector 118 may associate one of the hand guard members 102 with the firearm 150, and the clamping device 120 may clamp the connector 118 to the firearm 150. In embodiments, the connector 118 may associate the hand guard member 102 with the barrel nut 155 of the firearm 150, and the clamping device 120 may clamp the connector 118 to the barrel nut 155, thereby securing the hand guard member 102 to the firearm 150.

In embodiments, the connector 118 may be adapted to mate with the flange 161 of the barrel nut 155, and the clamping device 120 may be adapted to secure at least a portion of the connector 118 against the flange 161. In such embodiments, the connector 118 may be positioned on a rearward transverse edge 122 of the hand guard member 102. The connector 118 may include a forward rim 124, a rearward rim 126, and an annular groove 128 formed between these rims. The annular groove 128 may be sized and shaped to mate with the flange 161 on the barrel nut 155, and the rims 124, 126 may be sized and shaped to extend over at least a portion of the flange 161. Thus, when the hand guard member 102 is positioned adjacent to the firearm 150 in the intended orientation, the annular groove 128 of the connector 118 may accept the flange 161, with the rearward rim 126 becoming positioned on the rearward side of the flange 161 and the forward rim 124 becoming positioned on the forward side of the flange 161. Thus, the flange 161 may become sandwiched between the rims 124, 126.

The clamping device 120 may be adapted to clamp at least a portion of the connector 118 against the barrel nut 155. For example, the clamping device 120 may clamp at least a portion of the connector 118 to at least a portion of the flange 161 of the barrel nut 155. Thus, the hand guard member 102 may be secured to the barrel nut 155. More specifically, the clamping device 120 may apply a clamping force to the connector 118 and the barrel nut 161. The clamping force may be applied in a direction that is generally parallel to the longitudinal axis of the barrel 153. In the illustrated embodiment, the clamping device 120 may be adapted to force the flange 161 of the barrel nut 155 against the rearward rim 126 of the connector 118, such that the connector 118 of the hand guard member 102 remains securely positioned about the barrel nut 155.

Figure 2:
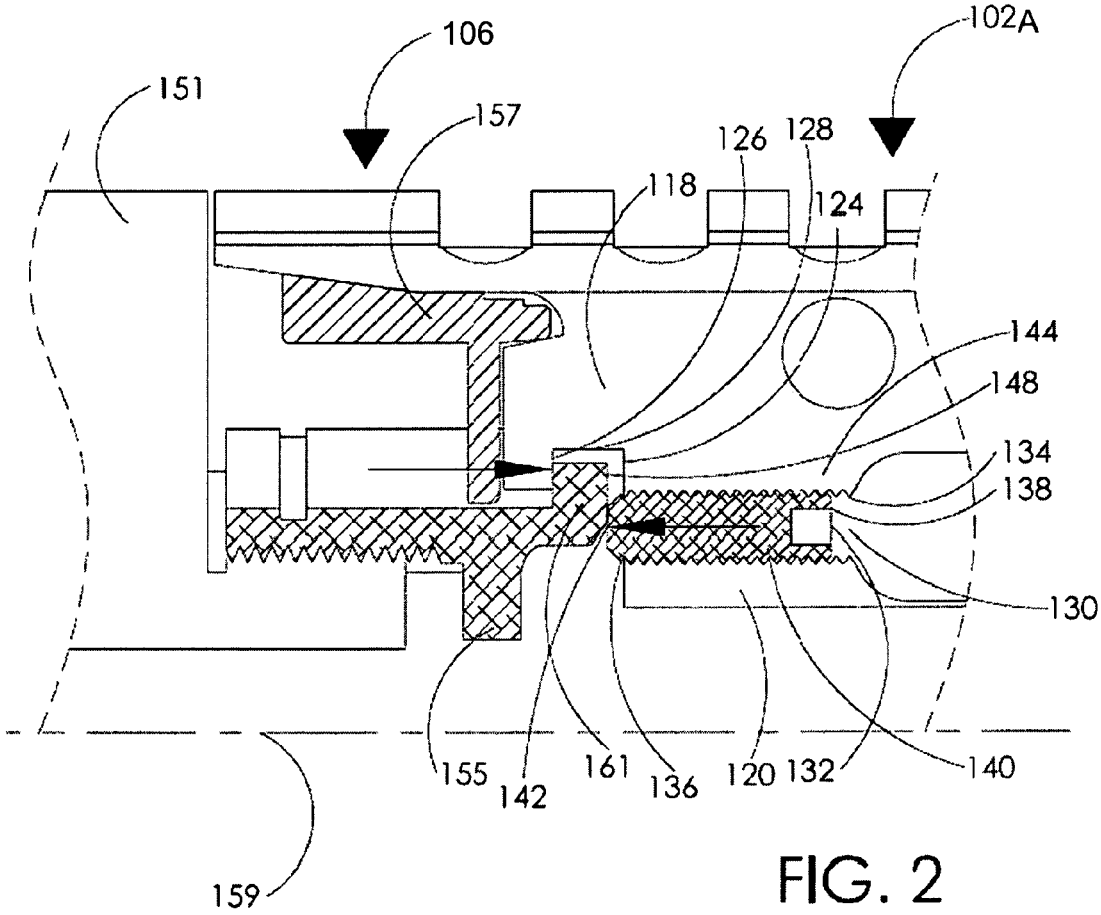
FIG. 2 is a partial cross-sectional view of the hand guard assembly shown in FIG. 1, illustrating a securing mechanism of the hand guard assembly, in accordance with an embodiment of the invention.

Such a configuration is shown in FIG. 2, which is a partial cross-sectional view of the hand guard assembly 100, illustrating an embodiment of the connector 118 and the clamping device 120 of the securing mechanism 106. For the purposes of example, the upper hand guard member 102A is illustrated, oriented such that the upper receiver 151 is on the left side of the page and the barrel (not shown) extends off of the right side of the page. The clamping device 120 may include a threaded opening 130 formed through the forward rim 124 of the connector 118, and a set screw 132 positioned in the threaded opening 130. The threaded opening 130 may have threads 134 on an interior cylindrical surface. When the connector 118 is positioned about the flange 161 of the barrel nut 155, a central axis of the threaded opening 130 may be generally parallel to the longitudinal axis 159 of the barrel 153.

The set screw 132 may be positioned in the threaded opening 130. The set screw 132 may have a head 138, a threaded shaft 140, and a tip 142. The head 138 of the set screw 132 may be on a forward side 144 of the forward rim 124. The tip 142 of the set screw 132 may be positioned on a rearward side 146 of the forward rim 124 between the forward rim 124 and the flange 161 of the barrel nut 155. Threads 136 on the threaded shaft 140 may engage the threads 134 on the interior cylindrical surface of the threaded opening 130. The threaded shaft 140 may extend in a direction that is generally parallel to the longitudinal axis 159 of the barrel 153.

To secure the hand guard member 102 to the firearm 150, the set screw 132 may be rotated in the threaded opening 130. Rotation of the set screw 132 through the threaded opening 130 may cause the set screw 132 to translate in a direction generally parallel to the longitudinal axis 159 of the barrel 153. Initially, the set screw 132 may translate with respect to the threaded opening 130 and with respect to the flange 161 of the barrel nut 155, but as the set screw 132 translates rearward and toward the upper receiver 151, the tip 142 of the set screw 132 may contact a forward side 148 of the flange 161 of the barrel nut 155. Thereafter, the set screw 132 may impart a force on the forward side 148 of the flange 161, and the flange 161 may exert a return force on the set screw 132. The return force may impede the set screw 132 from translating rearward with respect to the barrel nut 155. Thus, with continued rotation of the set screw 132, the threaded opening 130 may begin translating forward along the threaded shaft 140 of the set screw 132, causing the connector 118 and therefore the entire hand guard member 102 to translate forward. The forward movement of the connector 118 may cause the rearward rim 126 of the connector 118 to catch against the flange 161 of the barrel nut 155, so that the flange 161 of the barrel nut 155 becomes clamped between the tip 142 of the set screw 132 and the rearward rim 126 of the connector 118, securing the hand guard member 102 to the barrel nut 155.

The clamping device 120 may create a relatively uniformly distributed force on the barrel nut 155. For example, the threaded openings 130 may be relatively symmetrically distributed on the hand guard members 102. As shown in the embodiment illustrated in FIG. 1, two threaded openings 130 may be formed through the upper hand guard member 102A, and two threaded openings 130 may be formed through the lower hand guard member 102B. The threaded openings 130 may be symmetrically distributed on opposite longitudinal edges 110 of the hand guard members 102, and corresponding set screws 132 may be positioned in the threaded openings 130. Thus, in the embodiment illustrated in FIG. 1, each hand guard member 102 is clamped to the barrel nut 155 in two separate places.

In other embodiments, the clamping device 120 may have other configurations. For example, any number or alternative positioning of clamping devices 120 may be used. Further, the clamping devices 120 may not be set screws 132 that travel through threaded housings 130 in the hand guard members 102. Also, any number or alternative positioning of connectors 118 may be used. In the illustrated embodiment, each hand guard member 102 may have a connector 118 located on the rearward transverse edge 122, while in other embodiments some of the hand guard members 102 may not have a connector 118. In such embodiments, the coupling mechanism 104 may couple a hand guard member 102 that does not have a connector 118 to another hand guard member 102 that does have a connector 118.

The securing mechanism 106 may be configured to be releasable so that the hand guard member 102 can be removed from the barrel nut 155 if desired. For example, the set screws 132 may be removed from the threaded openings 130 in the illustrated embodiment. However, the securing mechanism 106 may not be releasable in other embodiments, or the securing mechanism 106 may be releasable in other manners.

Figure 3:
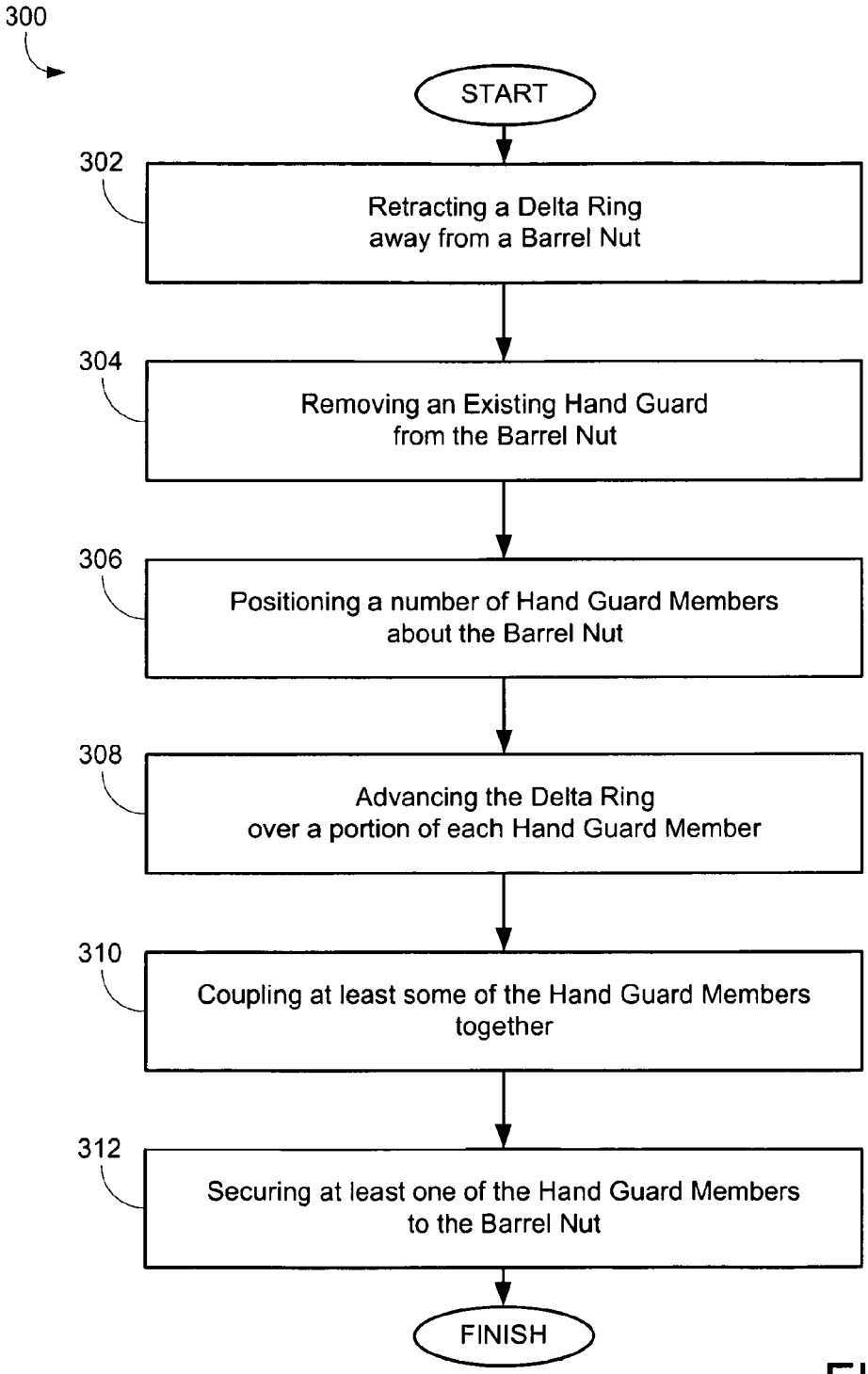
FIG. 3 is a block diagram illustrating a method of installing a hand guard on a firearm, in accordance with an embodiment of the invention.

FIG. 3 is a block diagram illustrating an embodiment of a method 300 for installing a hand guard on a firearm 150. Generally, a firearm 150 may include a barrel 153, a barrel nut 155, a delta ring 157, and in some embodiments, an existing hand guard. In some embodiments, the existing hand guard may be positioned about the barrel 153 and may be coupled to the firearm 150 using the barrel nut 155 and the delta ring 157. More specifically, the existing hand guard may be positioned between the barrel nut 155 and the delta ring 157. The existing hand guard may mate with the scalloped flange 161 of the barrel nut 155, and the delta ring 157 may extend over a portion of the existing hand guard to generally retain the existing hand guard in place.

The method 300 begins at block 302. In block 302, the delta ring 157 may be retracted away from the barrel nut 155. In embodiments in which the firearm 150 includes an existing hand guard, retracting the delta ring 157 may comprise moving the delta ring 157 from an extended position, in which the delta ring 157 extends over a portion of the existing hand guard, to a retracted position, in which the delta ring 157 does not extend over the existing hand guard. In embodiments in which the delta ring 157 is spring operated, retracting the delta ring 157 may comprise moving the delta ring 157 from a rest position, in which the delta ring 157 is at rest, to a retracted position, in which the spring of the delta ring 157 is loaded. In the retracted position, the delta ring 157 may return to the rest position unless a force is applied to retain the delta ring 157 in the retracted position. In such embodiments, retracting the delta ring 157 away from the barrel nut 155 may further include applying a force to retain the delta ring 157 in the retracted position. For example, the delta ring 157 may be manually retained in the retracted position using a hand of the user.

Block 302 is followed by block 304. In block 304, the existing hand guard may be removed from the barrel nut 155 of the firearm 150. The manner in which the existing hand guard is removed may depend on the configuration of the existing hand guard. For example, the existing hand guard may include several pieces, in which cases removing the existing hand guard may comprise separating the several pieces and lifting the several pieces from the barrel nut 155. In other cases, removing the existing hand guard may comprise sliding the existing hand guard off of the barrel nut 155 and along the barrel 153 of the firearm 150. It should be noted that block 304 may by omitted in embodiments in which the firearm 150 does not include an existing hand guard.

Block 304 is followed by block 306. In block 306, a number of hand guard members 102 may be positioned about the barrel 153 of the firearm 150. Each hand guard member 102 is oriented so that a longitudinal axis 159 of the hand guard member 102 is generally parallel to a longitudinal axis 159 of the barrel 153. A connector 118 on each hand guard member 102 may be mated with the barrel nut 155. For example, an annular groove 128 on the connector 118 of the hand guard member 102 may be positioned in mating relation with at least a portion of the flange 161 of the barrel nut 155.

Block 306 is followed by block 308. In block 308, the delta ring 157 can be advanced over a portion of each hand guard member 102. In embodiments in which the delta ring 157 is spring loaded, the delta ring 157 may be advanced over a portion of each hand guard member 102 by releasing the force that retains the delta ring 157 in the retracted position so that the delta ring 157 returns to the rest position. In other embodiments, the delta ring 157 may be advanced over a portion of each hand guard member 102 by moving the delta ring 157 from the retracted position to the extended position.

Block 308 is followed by block 310. In block 310, at least some of the hand guard members 102 can be coupled together to form a hand guard. In some embodiments, each hand guard member 102 is coupled to each adjacent hand guard member 102, such that the hand guard members 102 form a relatively continuous hand guard enclosing at least a portion of the circumference of the barrel 153. In other embodiments, only some of the adjacent hand guard members 102 may be coupled together. In still other embodiments, none of the hand guard members 102 may not be coupled together, in which case block 310 may be omitted from the method 300 completely. The hand guard members 102 may be coupled together in a variety of manners. For example, fasteners such as screws may be passed through passages 114 on some of the hand guard members 102 into threaded couplings 116 on other hand guard members 102 such that the hand guard members 102 become securely coupled together. Alternatively, the hand guard members 102 may have snap fittings or pressure fittings that engage each other to couple the hand guard members 102 together.

Block 310 is followed by block 312. In block 312, at least one of the hand guard members 102 may be secured to the barrel nut 155. Securing the hand guard member 102 to the barrel nut 155 may comprise clamping a connector 118 on the hand guard member 102 to the barrel nut 155. More specifically, a clamping force may be applied to the connector 118 and the barrel nut 155. The clamping force may be applied in a direction that is generally parallel to a longitudinal axis 159 of the barrel 153. For example, a set screw 132 can be used to apply the clamping force. The set screw 132 may be moved through a threaded coupling 116 in the hand guard member 102 to force the flange 161 on the barrel nut 155 against a rearward rim 126 of the connector 118. In other embodiments, the hand guard members 102 can be secured to the barrel nut 155 in other manners. In some embodiments, each hand guard member 102 is secured to the barrel nut 155, while in other embodiments, some of the hand guard members 102 may not be secured to the barrel nut 155. The method ends after block 312.

It should be noted that the order of some of the blocks of the method 300 may be altered in some embodiments. For example, the order of block 310 and block 312 may be reversed, so that the hand guard members 102 are secured to the barrel nut 155 before the hand guard members 102 are coupled together. Additionally, block 308 may be performed at any point after block 304, so that the delta ring 157 is returned to the rest position.

Certain embodiments of systems and methods described above can be employed to install an embodiment of the hand guard assembly 100 on a firearm 150. In certain embodiments, the hand guard assembly 100 may be installed without removing one or more of the barrel nut 155, the delta ring 157, the front sight base, the hand guard cap, or the gas tube, among others. In certain embodiments, the hand guard assembly 100 can be installed by an individual with limited tools and skills. In certain embodiments, the hand guard assembly 100 may be one or more of a free-floating hand guard or a rail assembly, among others. Also in some embodiments, a relatively secure yet releasable connection can be created between the hand guard assembly 100 and the firearm 150, so that the hand guard assembly 100 can be removed from the firearm 150 as desired.

While particular embodiments of systems and methods for installing a hand guard on a firearm have been disclosed in detail for purposes of example, those skilled in the art will understand that variations and modifications may be made without departing from the scope of the disclosure. All such variations and modifications are intended to be included within the scope of the present disclosure, as protected by the following claims.

The claimed invention is:

1. A hand guard assembly for installing on a firearm, the firearm having a barrel nut with a flange, the hand guard assembly comprising:

a plurality of hand guard members;

a coupling mechanism configured to couple at least some of the hand guard members together; and a securing mechanism configured to secure at least one of the hand guard members to the barrel nut, the securing mechanism applying a clamping force in a direction generally parallel to a longitudinal axis of the firearm, wherein the securing mechanism comprises:

a connector adapted to associate at least one of the hand guard members with the barrel nut, wherein the connector is sized and shaped to mate with at least a portion of the flange; and a clamping device comprising a threaded opening formed through the connector and a set screw positioned in the threaded opening, wherein the clamping device is adapted to clamp the connector against the flange of the barrel nut.

2. The hand guard assembly of claim 1, wherein at least some of the plurality of hand guard members comprise an upper hand guard member and a lower hand guard member.

3. The hand guard assembly of claim 1, wherein each hand guard member is sized so that an interior surface of the hand guard member is spaced apart from the firearm when the hand guard member is positioned adjacent to the firearm.

4. The hand guard assembly of claim 1, wherein the coupling mechanism comprises:

a passageway through a first of the hand guard members;

a threaded opening within a second of the hand guard members; and a fastener that can be passed through the passageway into the threaded opening to secure the first of the hand guard members to the second of the hand guard members.

5. The hand guard assembly of claim 1, wherein:

the connector comprises a forward rim, a rearward rim, and an annular groove positioned between the forward rim and a rearward rim, the annular groove being sized and shaped to mate with at least a portion of the flange; and the clamping device is adapted to clamp the flange against the rearward rim.

6. The hand guard assembly of claim 1, wherein the threaded opening extends in a direction generally parallel to the longitudinal axis.

7. A hand guard assembly for installing on a firearm, the firearm having a barrel nut with a flange, the hand guard assembly comprising:

a plurality of hand guard members, wherein at least some of the plurality of hand guard members comprise an upper hand guard member and a lower hand guard member, and wherein each hand guard member is sized so that an interior surface of the hand guard member is spaced apart from the firearm when the hand guard member is positioned adjacent to the firearm;

a coupling mechanism configured to couple at least some of the hand guard members together, wherein the coupling mechanism comprises:

a passageway through a first of the hand guard members;

a threaded opening within a second of the hand guard members; and a fastener that can be passed through the passageway into the threaded opening to secure the first of the hand guard members to the second of the hand guard members; and a securing mechanism configured to secure at least one of the hand guard members to the barrel nut, the securing mechanism applying a clamping force in a direction generally parallel to a longitudinal axis of the firearm, wherein the securing mechanism comprises:

a connector adapted to associate at least one of the hand guard members with the barrel nut, wherein the connector is sized and shaped to mate with at least a portion of the flange; and a clamping device comprising a threaded opening formed through the connector and a set screw positioned in the threaded opening, wherein the clamping device is adapted to clamp the connector against the flange of the barrel nut.

8. The hand guard assembly of claim 7, wherein:

the connector comprises a forward rim, a rearward rim, and an annular groove positioned between the forward rim and a rearward rim, the annular groove being sized and shaped to mate with at least a portion of the flange; and the clamping device is adapted to clamp the flange against the rearward rim.

9. The hand guard assembly of claim 7, wherein the threaded opening extends in a direction generally parallel to the longitudinal axis.

10. A method for providing a hand guard assembly for installing on a firearm having a barrel nut, the method comprising:

providing a plurality of hand guard members;

providing a coupling mechanism configured to couple at least some of the hand guard members together; and manipulating a securing mechanism to secure at least one of the hand guard members to the barrel nut, the securing mechanism applying a clamping force in a direction generally parallel to a longitudinal axis of the firearm.

11. The method of claim 10, wherein at least some of the plurality of hand guard members comprise an upper hand guard member and a lower hand guard member.

12. The method of claim 10, wherein each hand guard member is sized so that an interior surface of the hand guard member is spaced apart from the firearm when the hand guard member is positioned adjacent to the firearm.

13. The method of claim 10, wherein the coupling mechanism comprises:

a passageway through a first of the hand guard members;

a threaded opening within a second of the hand guard members; and a fastener that can be passed through the passageway into the threaded opening to secure the first of the hand guard members to the second of the hand guard members.

14. The method of claim 10, wherein the securing mechanism comprises:

a connector adapted to associate at least one of the hand guard members with the barrel nut; and a clamping device adapted to clamp the connector against the barrel nut.

15. The method of claim 14, the barrel nut having a flange, wherein:

the connector comprises a forward rim, a rearward rim, and an annular groove positioned between the forward rim and a rearward rim, the annular groove being sized and shaped to mate with at least a portion of the flange; and the clamping device is adapted to clamp the flange against the rearward rim.

16. The method of claim 14, the barrel nut having a flange, wherein:

the connector is sized and shaped to mate with at least a portion of the flange; and the clamping device comprises a threaded opening formed through the connector and a set screw positioned in the threaded opening.

17. The method of claim 16, wherein the threaded opening extends in a direction generally parallel to the longitudinal axis.

* * * * *